US008079853B2

(12) United States Patent
Tanaka

(10) Patent No.: US 8,079,853 B2
(45) Date of Patent: Dec. 20, 2011

(54) HIGH-SPEED DIFFERENTIAL TRANSMISSION CONNECTOR

(75) Inventor: Yukitaka Tanaka, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 212 days.

(21) Appl. No.: 12/455,419

(22) Filed: Jun. 2, 2009

(65) Prior Publication Data

US 2009/0305534 A1 Dec. 10, 2009

(30) Foreign Application Priority Data

Jun. 5, 2008 (JP) ..... 2008-148591

(51) Int. Cl.
*H01R 13/648* (2006.01)

(52) U.S. Cl. ..... 439/108

(58) Field of Classification Search ..... 439/108, 439/579, 637, 497, 660
See application file for complete search history.

(56) References Cited

U.S. PATENT DOCUMENTS

| | | | | |
|---|---|---|---|---|
| 4,602,831 | A * | 7/1986 | Lockard | 439/108 |
| 6,817,898 | B2 | 11/2004 | Tanaka et al. | |
| 6,951,487 | B2 * | 10/2005 | Ozai | 439/637 |
| 7,320,623 | B2 | 1/2008 | Hisamatsu et al. | |
| 7,462,071 | B1 * | 12/2008 | Wu | 439/607.05 |
| 7,497,704 | B2 * | 3/2009 | Saito et al. | 439/108 |
| 7,824,198 | B2 * | 11/2010 | Tanaka | 439/108 |
| 2006/0046569 | A1 * | 3/2006 | Kondou et al. | 439/608 |
| 2006/0228935 | A1 * | 10/2006 | Wen et al. | 439/497 |

FOREIGN PATENT DOCUMENTS

| | | |
|---|---|---|
| JP | 2003-109708 | 4/2003 |
| JP | 3-564556 | 6/2004 |
| JP | 2007-157534 | 6/2007 |
| JP | 2007-207738 | 8/2007 |

OTHER PUBLICATIONS

Machine Translation of JP 2007-207738 A, Aug. 2007.*
Japanese Office Action dated Feb. 12, 2010 with English translation.

* cited by examiner

*Primary Examiner* — Vanessa Girardi
(74) *Attorney, Agent, or Firm* — Collard & Roe, P.C.

(57) ABSTRACT

A connector comprises a plurality of ground contacts, a housing, a coupling portion, and a second connection portion. The ground contacts are provided with first connection portions, respectively, which are to be connected to drain lines of first cables, respectively. The housing holds the ground contacts so that each of the ground contacts extends along a first direction. The coupling portion is formed integrally with the ground contacts. The coupling portion couples the ground contacts so that the ground contacts are arranged in a second direction perpendicular to the first direction. The second connection portion is formed integrally with the coupling portion. The second connection portion is configured to be connected to a large-diameter line of a second cable different from the first cables. The second connection portion extends along the first direction and is larger than the first connection portion in the second direction.

8 Claims, 7 Drawing Sheets

HIGH-SPEED DIFFERENTIAL TRANSMISSION CONNECTOR

CROSS REFERENCE TO RELATED APPLICATIONS:

An applicant claims priority under 35 U.S.C. §119 of Japanese Patent Application No. JP2008-148591 filed Jun. 5, 2008.

BACKGROUND OF THE INVENTION

This invention relates to a connector which comprises contact rows each including ground contacts. For example, the present invention relates to a connector to which cables are connected and which is for DisplayPort that is standardized by VESA (Video Electronics Standards Association).

JP-B 3564556 discloses a connector which comprises contact rows each including ground contacts. The disclosed connector further comprises a ground plate which is connected to the ground contacts. The ground plate is formed with the cable holders.

A connector port compliant with the DisplayPort standard (referred to as "DisplayPort-compliant port", hereinafter) comprises two rows of contacts. Each of the contact rows consists of ten terminals so that the DisplayPort-compliant port comprises twenty terminals in total. The terminals include a power return (DP_PWR Return) terminal as a terminal No. 19 and a power supply (DP_PWR) terminal as a terminal No. 20. The power return terminal belongs to one of the contact rows, while the power supply terminal belongs to the other contact row. In addition, the power return terminal and the power supply terminal are positioned at the ends of the contact rows, respectively; the power return terminal is positioned just above the power supply terminal. The power return terminal is configured to be earthed. In other words, the power return terminal can be applied with a voltage level same as that of ground terminals.

A connector compliant with the DisplayPort standard (referred to as "DisplayPort-compliant connector", hereinafter) comprises a plurality of contacts which correspond to the respective terminals of the DisplayPort-compliant port. In detail, the contacts of the DisplayPort-compliant connector include a power return contact and a power supply contact which correspond to the power return terminal and the power supply terminal, respectively.

Normally, a power-related cable such as a cable for power supply or a cable for power return has a conductive line which is larger in diameter than that of a transmission cable or a signal cable in order to reduce voltage drop on the power-related cable. The DisplayPort-compliant connector must be provided with larger or wider portions to which the conductive lines of the power-related cables are connected by soldering. However, the larger or wider portions for the power-related cables cause the size of the connector to be too large.

SUMMARY OF THE INVENTION

It is an object of the present invention to provide a connector which is provided with a larger or wider portion for a large-diameter cable such as the power-related cable but has a size as small as possible.

One aspect of the present invention provides a connector which comprises a plurality of ground contacts, a housing, a coupling portion, and a second connection portion. The ground contacts are provided with first connection portions, respectively, which are to be connected to drain lines of first cables, respectively. The housing holds the ground contacts so that each of the ground contacts extends along a first direction. The coupling portion is formed integrally with the ground contacts. The coupling portion couples the ground contacts so that the ground contacts are arranged in a second direction perpendicular to the first direction. The second connection portion is formed integrally with the coupling portion. The second connection portion is configured to be connected to a large-diameter line of a second cable different from the first cables. The second connection portion extends along the first direction and is larger than the first connection portion in the second direction.

An appreciation of the objectives of the present invention and a more complete understanding of its structure may be had by studying the following description of the preferred embodiment and by referring to the accompanying drawings.

Figure 1:
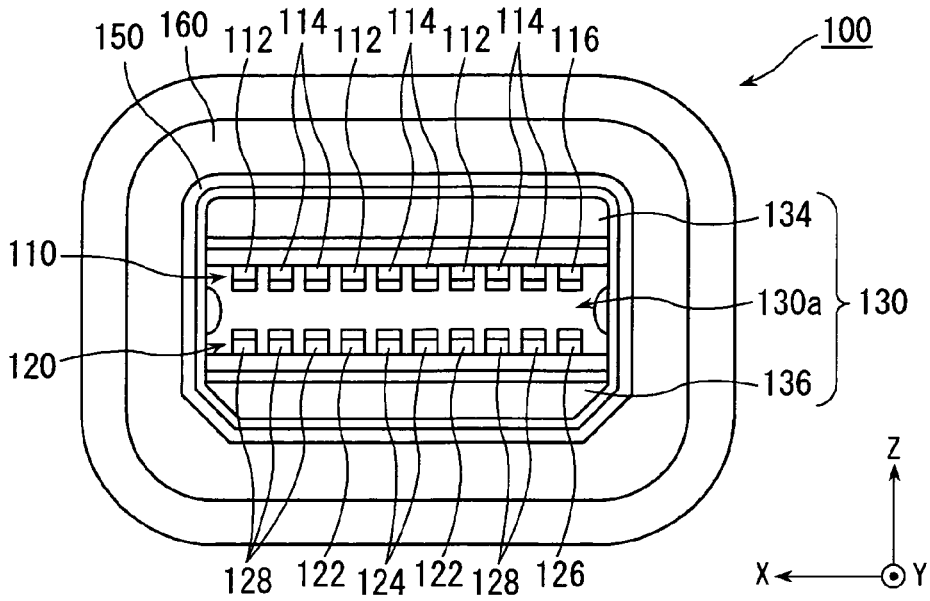
FIG. 1 is a front view showing a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
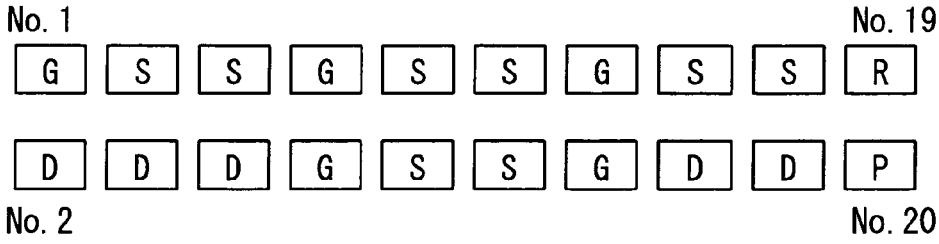
FIG. 2 is a view showing an arrangement of contacts of the connector of FIG. 1, as seen from its front.
Figure 3:
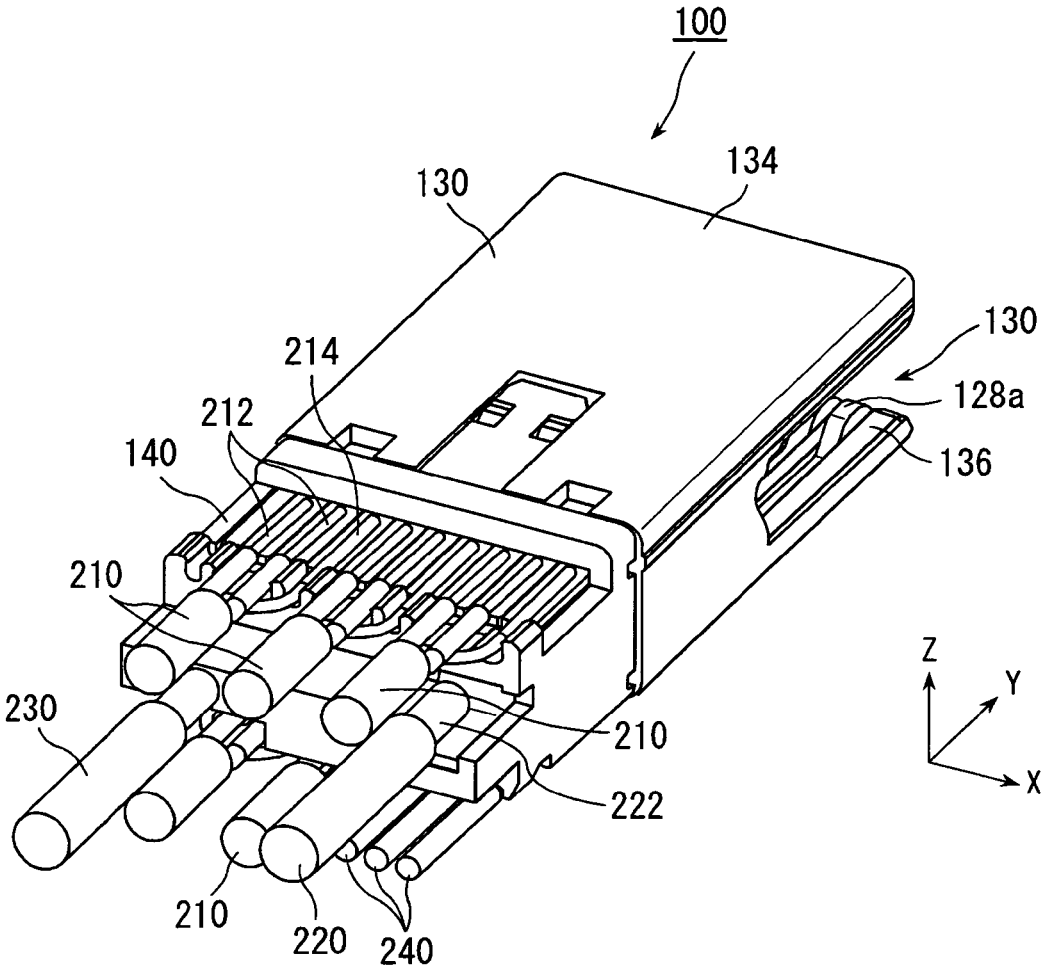
FIG. 3 is a top oblique view showing the connector of FIG. 1, wherein its hood and its shell are not shown.
Figure 4:
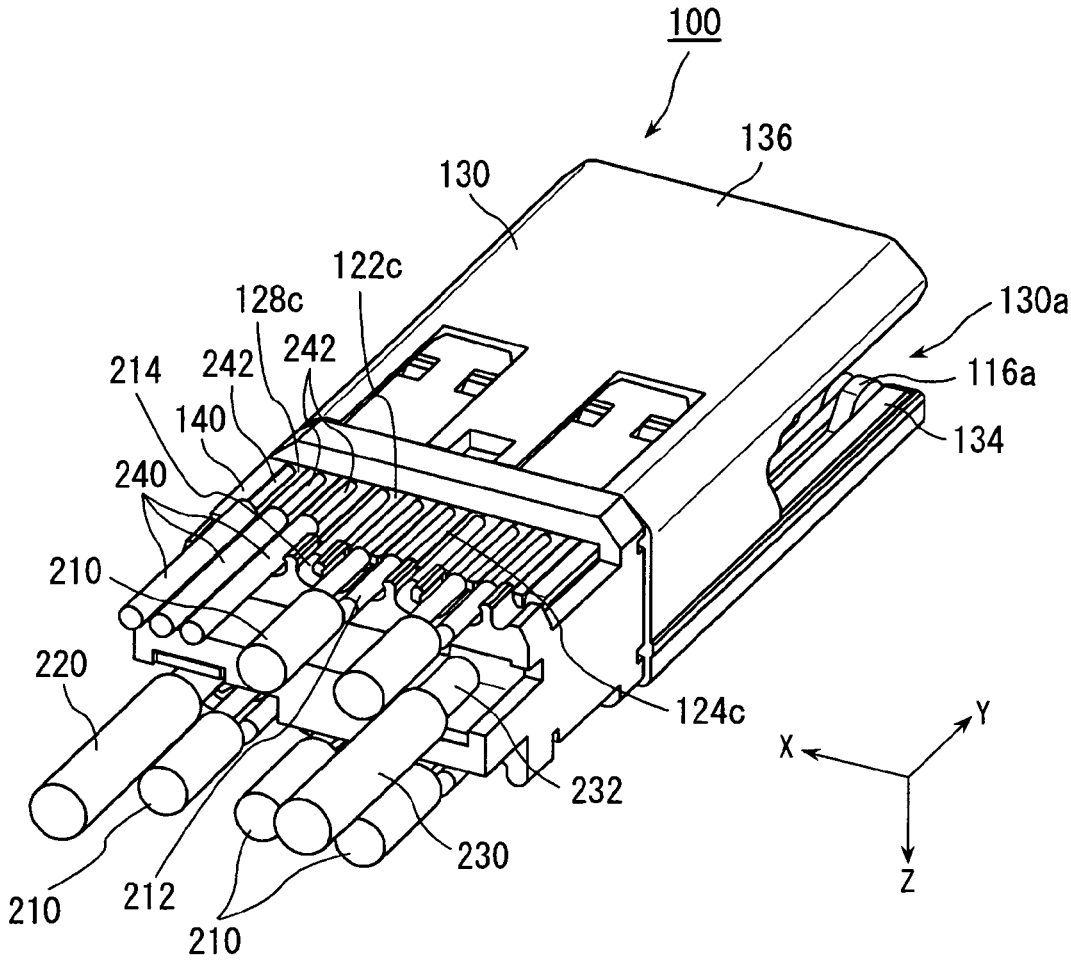
FIG. 4 is a bottom oblique view showing the connector of FIG. 3.
Figure 5:
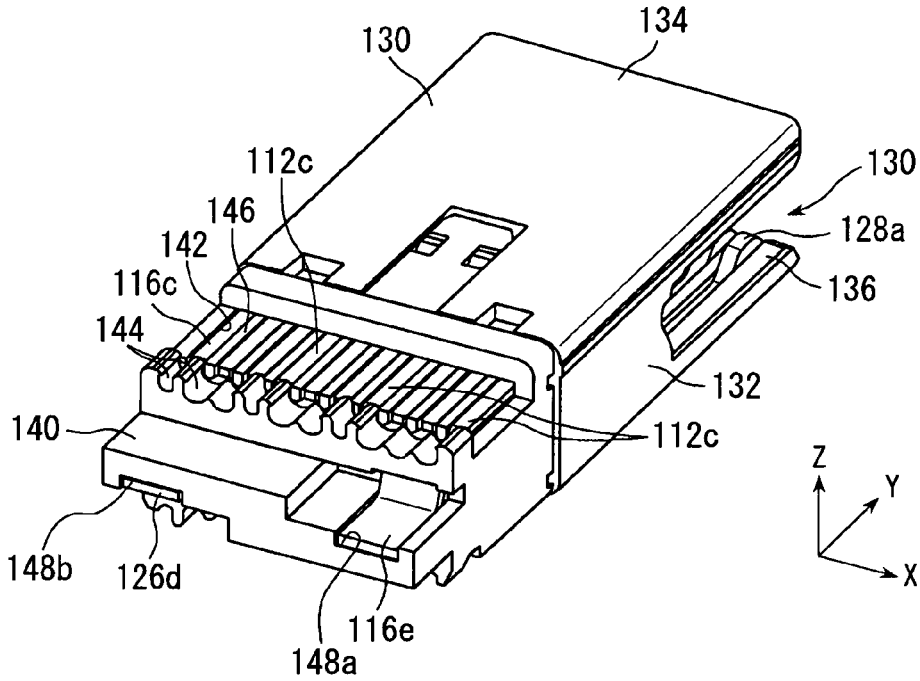
FIG. 5 is a top oblique view showing the connector of FIG. 3, wherein cables are not connected to the connector.
Figure 6:
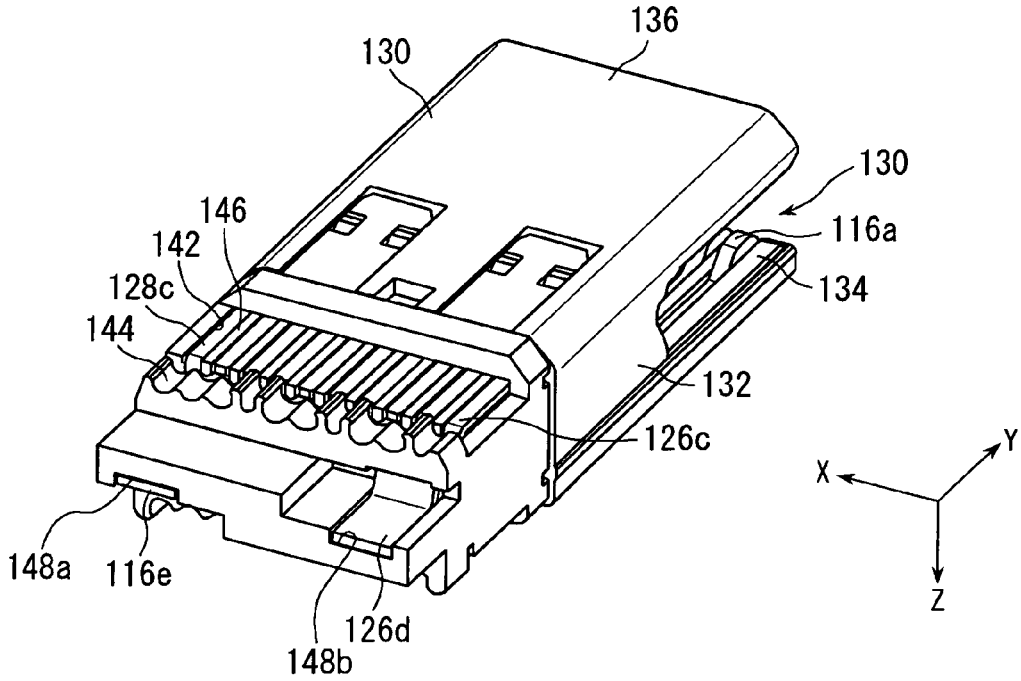
FIG. 6 is a bottom oblique view showing the connector of FIG. 4, wherein cables are not connected to the connector.

With reference to FIGS. 1 to 3, a connector 100 according to an embodiment of the present invention is a DisplayPort-compliant connector and comprises twenty contacts which correspond to twenty terminals of the DisplayPort-compliant port, respectively. The connector 100 of the present embodiment is configured to connect differential transmission cables (first cables) 210, a power return cable (second cable) 220, a power supply cable (third cable) 230 and single-ended transmission cables 240 to the DisplayPort-compliant port (not shown). As shown in FIGS. 3 and 4, each of the differential transmission cables 210 comprises two signal lines 212 and a drain line 214, wherein each of the signal lines 212 is used for high-speed signal, while the drain line 214 is to be grounded.

The power return cable 220 comprises a power return line 222. The power return line 222 is a large-diameter line which has a diameter larger than that of the signal line 212. The power supply cable 230 comprises a power supply line 232 which has a diameter same as the power return line 222. Each of the single-ended transmission cables 240 comprises a signal line 242 which is used for low-speed signal.

With reference to FIGS. 1, 3 and 4, the connector 100 comprises first and second contact rows 110, 120, a housing 130, a locator 140, a shell 150 and a hood 160. Each of the first and the second contact rows 110, 120 consists of ten contacts, as described in detail afterwards. The housing 130 is made of insulator and holds the first and the second contact rows 110, 120. The locator 140 is made of insulator and is attached to the housing 130. The shell 150 is made of metal and covers the housing 130 and the locator 140. The hood 160 is configured to protect connections of the contacts with the differential transmission cables and so on. The hood 160 of the present embodiment is not disposed at a front part of the connector 100 but is disposed only at a rear part of the connector 100.

Figure 9:
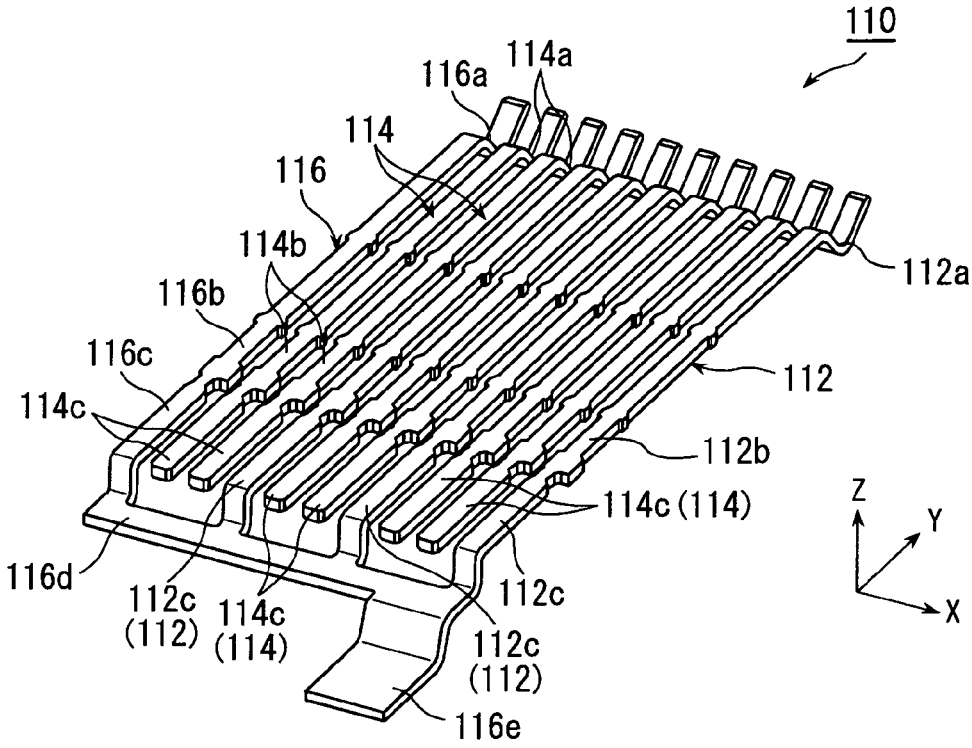
FIG. 9 is a top oblique view showing a first contact row included in the connector of FIG. 1.

With reference to FIGS. 1, 3 and 9, the first contact row 110 comprises three ground contacts 112, three pairs of signal contacts 114 and a ground contact 116. The signal contacts 114 are used for high-speed signal transmission such as differential transmission. The ground contact 116 of the present embodiment is also used as a power return contact which is to be connected to the power return terminal (DP_PWR Return) of the DisplayPort-compliant port.

Figure 10:
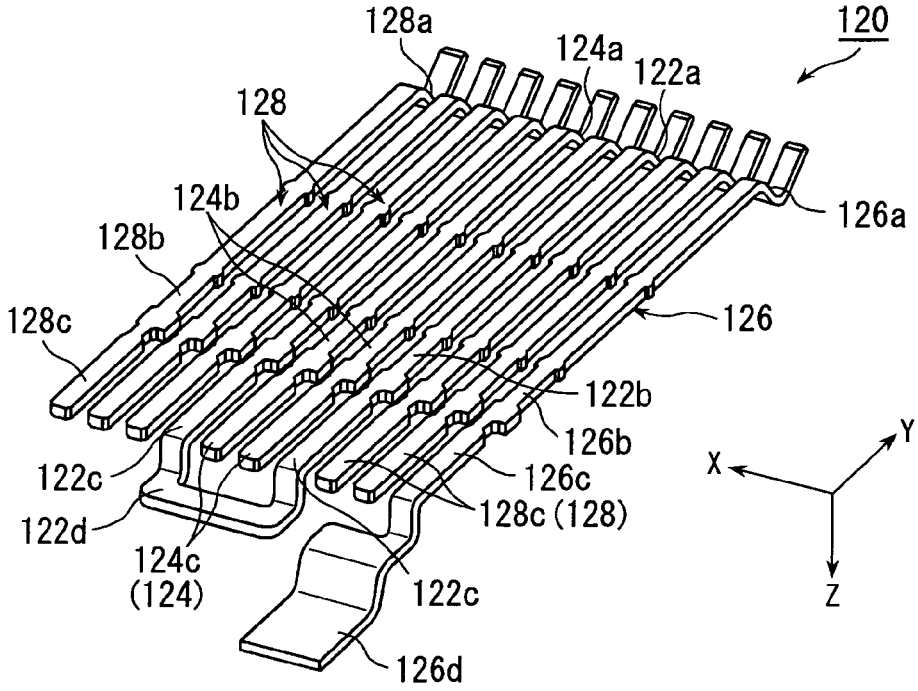
FIG. 10 is a bottom oblique view showing a second contact row included in the connector of FIG. 1.
Figure 11:
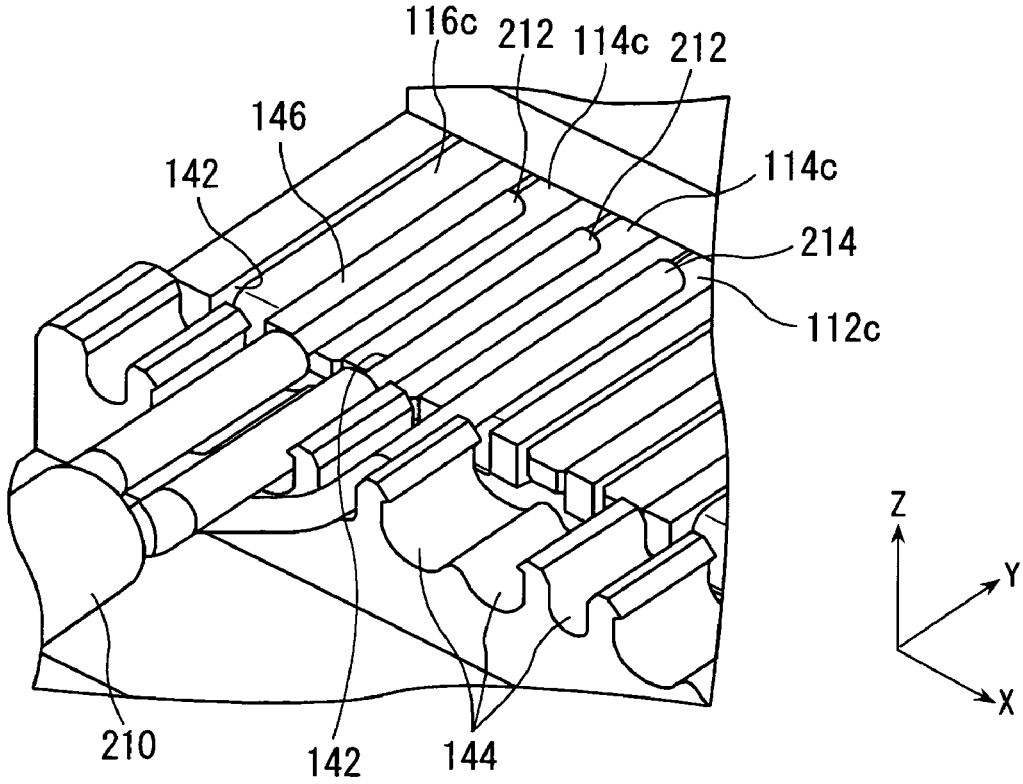
FIG. 11 is a partial, enlarged view showing connections between a cable and contacts.

With reference to FIGS. 1, 4 and 10, the second contact row 120 comprises two ground contacts 122, a pair of signal contacts 124, a power supply contact (purpose-specified contact) 126 and five signal contacts 128. The signal contacts 124 are used for the high-speed transmission. The power supply contact 126 is to be connected to the power supply terminal (DP_PWR) of the DisplayPort-compliant port. The signal contacts 128 are used for low-speed transmission such as single-ended transmission.

The first and the second contact rows 110, 120 are arranged as shown in FIG. 2 so that the first and the second contact rows 110, 120 correspond to each other in a Z-direction (third direction). In FIG. 2, a symbol "G" represents the ground contact 112 or the ground contact 122, a symbol "S" represents the signal contact 114 or the signal contact 124, a symbol "P" represents the power supply contact 126, a symbol "R" represents the ground contact 116, and a symbol "D" represents the signal contact 128. As apparent from FIG. 2, the ground contact 116 and the power supply contact 126 correspond to No. 19 terminal and No. 20 terminal of the DisplayPort-compliant port, i.e. the power return terminal (DP_PWR Return) and the power supply terminal (DP_PWR). The ground contact 116 is positioned just above the power supply contact 126. In addition, each pair of the signal contacts 114 is positioned between two of the ground contacts 112 closest to each other in an X-direction (second direction) or between the ground contact 116 and the ground contact 112 closest thereto among the ground contact 112. Thus, every pair of the signal contacts 114 is electrically shielded by the ground contacts 112 and the ground contact 116. Likewise, a pair of the signal contacts 124 is positioned between the ground contacts 122 so that the pair of the signal contacts 124 is electrically shielded by the ground contacts 122.

With reference to FIG. 9, each of the ground contacts 112 extends along a Y-direction (first direction) and comprises a contact portion 112*a*, a held portion 112*b* and a first connection portion 112*c*. The contact portion 112*a* is configured to be connected with the ground terminal of the DisplayPort-compliant port. The held portion 112*b* extends backwards from the contact portion 112*a* and is held by the housing 130. The first connection portion 112*c* extends backwards from the held portion 112*b*. The first connection portion 112*c* is configured to be connected with the drain line 214 of the differential transmission cable 210 by soldering, as understood from FIGS. 3, 5, 7, 9 and 11. As apparent from the above-description, the contact portion 112*a* and the first connection portion 112*c* are opposite end portions of each ground contact 112 in the Y-direction.

With reference to FIG. 9, each of the signal contacts 114 extends along the Y-direction and comprises a contact portion 114*a*, a held portion 114*b* and a soldered portion 114*c*. The contact portion 114*a* is configured to be connected with the high-speed signal terminal of the DisplayPort-compliant port. The held portion 114*b* extends backwards from the contact portion 114*a* and is held by the housing 130. The soldered portion 114*c* is configured to be connected with the signal line 212 of the differential transmission cable 210 by soldering, as understood from FIGS. 3, 5, 7, 9 and 11.

With reference to FIG. 9, the ground contact 116 extends along the Y-direction and comprises a contact portion 116*a*, a held portion 116*b* and a portion 116*c*. The contact portion 116*a* is configured to be connected with the power return terminal (DP_PWR Return) of the DisplayPort-compliant port. The held portion 116*b* extends backwards from the contact portion 116*a* and is held by the housing 130. The portion 116*c* extends backwards from the held portion 116*b* and corresponds to the first connection portion 112*c*. As apparent from the above-description, the contact portion 116*a* and the portion 116*c* are opposite end portions of the ground contact 116 in the Y-direction.

In this embodiment, the first connection portions 112*c* and the portion 116*c* are coupled by a coupling portion 116*d* which extends along the X-direction. From the coupling portion 116*d*, a second connection portion 116*e* extends in the Y-direction. Specifically, the second connection portion 116*e* extends from the coupling portion 116*d* in an orientation opposite to another orientation in which each of the ground contacts 112, 116 extends from the coupling portion 116*d*. In addition, the coupling portion 116*d* has two ends in the X-direction; the portion 116*c* of the ground contact 116 is coupled to one end of the coupling portion 116*d*; the second connection portion 116*e* is coupled to the other end of the coupling portion 116*d*. Therefore, the ground contact 116, the coupling portion 116*d* and the second connection portion 116*e* have a crank shape, as seen along the Z-direction, i.e. as seen from the above.

As apparent from FIG. 9, the ground contacts 112, the ground contact 116, the coupling portion 116*d* and the second connection portion 116*e* are formed integrally with each other; they are formed as a single metal member. In addition, because the coupling portion 116*d* of the present embodiment couples only the first connection portions 112*c* and the portion 116*c* with the second connection portion 116*e*, total amount of material for the single metal member including the coupling portion 116*d* can be made less. The present invention is however not limited thereto. The coupling portion 116*d* may couple other portions of the ground contacts 112, 116 with the second connection portion 116*e*.

The second connection portion 116*e* is configured to be connected with the power return line 222 of the power return cable 220. In this embodiment, the second connection portion 116*e* is larger than the first connection portion 112*c* in the X-direction. In addition, as understood from FIG. 9, the second connection portion 116*e* is separated from the first connection portions 112*c* and the portion 116*c* in the Z-direction. This arrangement makes the size of the connector 100 small in the X-direction.

With reference to FIG. 10, each of the ground contacts 122 extends along the Y-direction and comprises a contact portion 122*a*, a held portion 122*b* and a soldered portion 122*c*. The contact portion 122*a* is configured to be connected with the ground terminal of the DisplayPort-compliant port. The held portion 122*b* extends backwards from the contact portion 122*a* and is held by the housing 130. The soldered portion 122*c* extends backwards from the held portion 122*b*. The soldered portion 122*c* is configured to be connected with the drain line 214 of the differential transmission cable 210 by soldering, as understood from FIGS. 4, 6, 8 and 10. As apparent from the above-description, the contact portion 122*a* and the soldered portion 122*c* are opposite end portions of each ground contact 122 in the Y-direction. The soldered portions 122*c* are coupled to each other through a coupling portion 122*d*, which extends in the X-direction.

With reference to FIG. 10, each of the signal contacts 124 extends along the Y-direction and comprises a contact portion 124*a*, a held portion 124*b* and a soldered portion 124*c*. The contact portion 124*a* is configured to be connected with the high-speed signal terminal of the DisplayPort-compliant port. The held portion 124*b* extends backwards from the contact portion 124*a* and is held by the housing 130. The soldered portion 124*c* extends backwards from the held portion 124*b*. The soldered portion 124*c* is configured to be connected with the signal line 212 of the differential transmission cable 210 by soldering, as understood from FIGS. 4, 6, 8 and 10.

With reference to FIG. 10, the power supply contact 126 extends along the Y-direction and comprises a contact portion 126*a*, a held portion 126*b*, a portion 126*c* and a third connection portion 126*d*. The contact portion 126*a* is configured to be connected with the power supply terminal (DP_PWR) of the DisplayPort-compliant port. The held portion 126*b* extends backwards from the contact portion 126*a* and is held by the housing 130. The portion 126*c* extends backwards from the held portion 126*b* and corresponds to the soldered portion 122*c*. The third connection portion 126*d* further extends backwards from the portion 126*c*, although the third connection portion 126*d* and the portion 126*c* are mainly laid on different levels than each other in the Z-direction. The third connection portion 126*d* is configured to be connected with the power supply line 232 of the power supply cable 230 by soldering, as understood from FIGS. 4, 6, 8 and 10. As shown in FIG. 10, the third connection portion 126*d* of the present embodiment is larger than the soldered portion 124*c* of the signal contact 124. Specifically, the third connection portion 126*d* has a size same as that of the second connection portion 116*e* in the X-direction.

With reference to FIG. 10, each of the signal contacts 128 extends along the Y-direction and comprises a contact portion 128*a*, a held portion 128*b* and a soldered portion 128*c*. The contact portion 128*a* is configured to be connected with the low-speed signal terminal of the DisplayPort-compliant port. The held portion 128*b* extends backwards from the contact portion 128*a* and is held by the housing 130. The soldered portion 128*c* is configured to be normally connected with the signal line 242 of the single-ended transmission cable 240 by soldering, as understood from FIGS. 4, 6, 8 and 10. In the present embodiment, the soldered portions 128*c* of the signal contacts 128 corresponding to No. 16 terminal and No. 18 terminal of the DisplayPort-compliant port are to be connected with the signal lines 212 of the differential transmission cable 210 and to be supplied with low-speed signals through the signal lines 212.

With reference to FIGS. 5 to 8, the housing 130 comprises a block 132, an upper portion (upper jaw portion) 134 and a lower portion (lower jaw portion) 136. The upper portion 134 and the lower portion 136 extend and project from the block 132 along the Y-direction, while the upper portion 134 and the lower portion 136 are separated from each other in the Z-direction. The space between the upper portion 134 and the lower portion 136 opens, as seen from the front of the connector 100 (See FIG. 1). In other words, the upper portion 134 and the lower portion 136 define an opening 130*a* which can receive a fit portion of the DisplayPort-compliant port.

Figure 7:
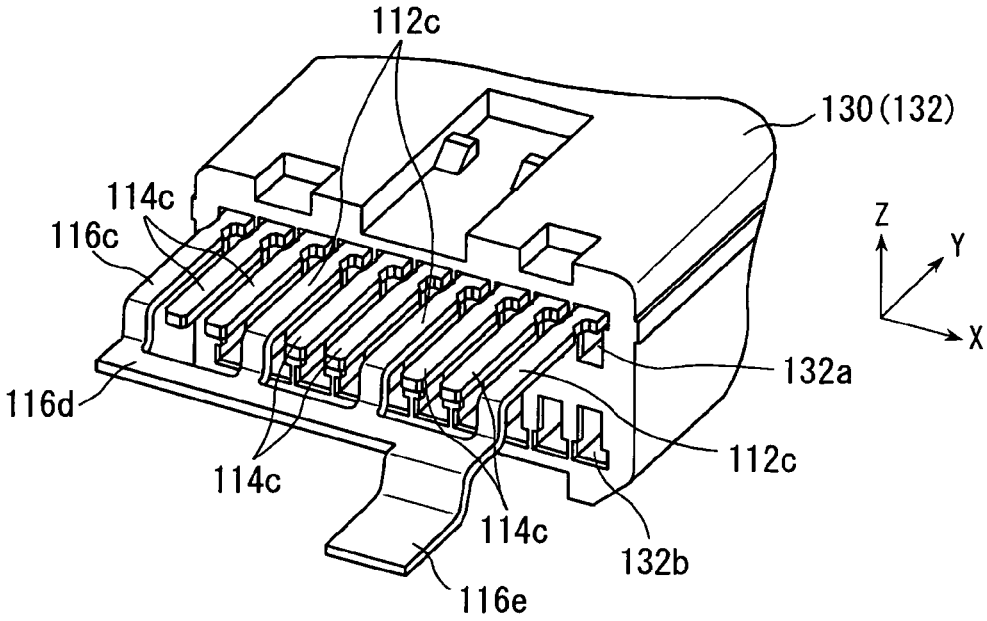
FIG. 7 is a partial, enlarged, top oblique view showing the connector of FIG. 5, wherein a locator is not shown.
Figure 8:
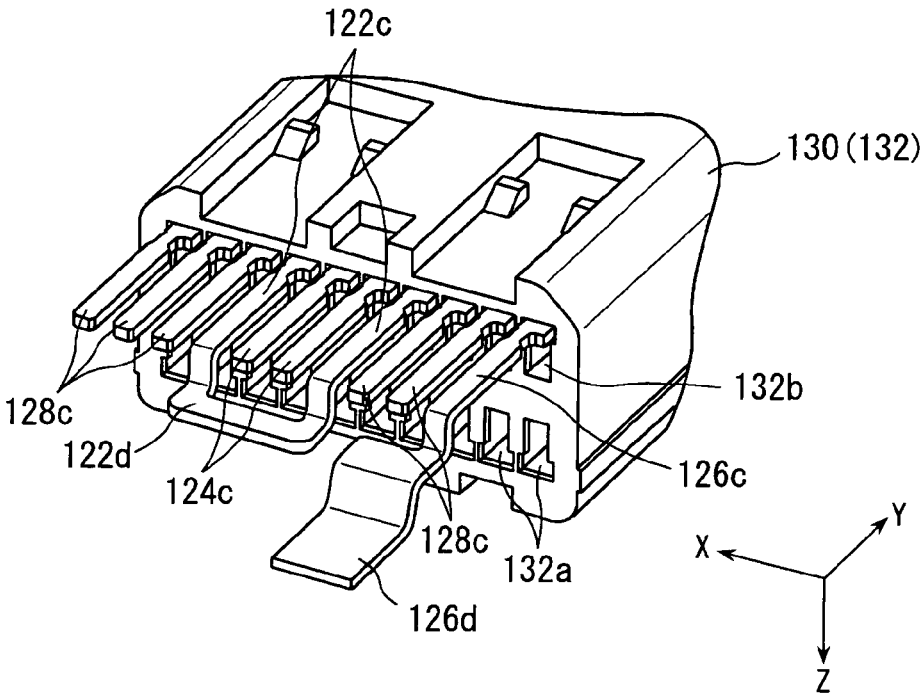
FIG. 8 is a partial, enlarged, bottom oblique view showing the connector of FIG. 6, wherein a locator is not shown.

With reference to FIGS. 7 and 8, the block 132 is formed with holding holes 132*a* and holding holes 132*b*. Each of the holding holes 132*a* is configured to hold each contact of the first contact row 110 and extends through the block 132 along the Y-direction. Likewise, each of the holding holes 132*b* is configured to hold each contact of the second contact row 120 and extends through the block 132 along the Y-direction. The upper portion 134 is formed with holding grooves which continue the holding holes 132*a*, respectively. The holding grooves are formed on the inner surface of the upper portion 134 and face the lower portion 136. The lower portion 136 is formed with holding grooves which continue the holding holes 132*b*, respectively. The holding grooves are formed inner surface of the lower portion 136 and face the upper portion 134.

As shown in FIG. 7, the contacts of the first contact row 110 are inserted into the block 132 along the Y-direction so that the held portions 112*b* of the ground contacts 112, the held portions 114*b* of the signal contacts 114 and the held portion 116*b* of the ground contact 116 are pressly-fit into the holding holes 132*a* and the holding grooves and are held thereby. Under the held state of the first contact row 110, the contact portions 112*a*, the contact portions 114*a* and the contact portion 116*a* project into the opening 130*a* from the upper portion 134.

As shown in FIG. 8, the contacts of the second contact row 120 are inserted into the block 132 along the Y-direction so that the held portions 122*b* of the ground contacts 122, the held portions 124*b* of the signal contacts 124, the held portion 126*b* of the power supply contact 126 and the held portion 128*b* of the signal contacts 128 are pressly-fit into the holding holes 132*b* and the holding grooves and are held thereby. Under the held state of the second contact row 120, the contact portions 122*a*, the contact portions 124*a*, the contact portion 126*a* and the contact portions 128*a* project into the opening 130*a* from the lower portion 136.

The locator 140 of the present embodiment is made of insulator. As understood from FIGS. 5 to 8 and 11, the locator 140 is attached to the rear end of the housing 130 after every contact is pressly-fit into the housing 130. The illustrated locator 140 is provided with a plurality of contact supporters 142, a plurality of locating hollows 144, a plurality of wall portions 146, a connection portion supporter 148*a* and a soldered portion supporter 148*b*.

The contact supporters 142 arrange and support the soldered portions 112*c*, 114*c*, 122*c*, 124*c*, 128*c* and the portions 116*c*, 126*c*, respectively. The locating hollows 144 locate and support the signal lines 212, 242 and the drain lines 214, respectively. The wall portions 146 and the contact supporters 142 are alternatively arranged so that each of the wall portions 146 separates neighboring signal contacts 114, 124, 128 or one of the ground contacts 112, 116, 122 and the signal contact 114, 124, 128 next to the ground contact 112, 116, 122. The wall portions 146 prevent the contacts from being short-circuited with each other.

The connection portion supporter 148*a* is configured to support the second connection portion 116*e*, while the soldered portion supporter 148*b* is configured to support the third connection portion 126*d*. The connection portion supporter 148*a* and the soldered portion supporter 148*b* are separated from the contact supporters 142 in the Z-direction. The power return line 222 and the power supply line 232 are prevented from being short-circuited with other signal lines 212, 242.

The connection portion supporter 148*a* and the soldered portion supporter 148*b* are separated from each other in the X-direction because of the arrangement of the power return cable 220 and the power supply cable 230 separately from each other in the X-direction. As mentioned above, the separate arrangement of the the power return cable 220 and the power supply cable 230 in the X-direction makes the size of the connector 100 small in the Z-direction.

The present application is based on a Japanese patent application of JP2008-148591 filed before the Japan Patent Office on Jun. 5, 2008, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector comprising:

a plurality of ground contacts, the ground contacts being provided with first connection portions, respectively, which are to be connected to drain lines of first cables, respectively;

a housing holding the ground contacts so that each of the ground contacts extends along a first direction;

a coupling portion formed integrally with the ground contacts, the coupling portion coupling the ground contacts so that the ground contacts are arranged in a second direction perpendicular to the first direction;

a second connection portion formed integrally with the coupling portion, the second connection portion being configured to be connected to a large-diameter line of a second cable different from the first cables, the second connection portion extending along the first direction and being larger than the first connection portion in the second direction; and a locator configured to hold the first cables;

wherein the locator is provided with a plurality of contact supporters;

wherein the first connection portions are separated from the second connection portion in a third direction perpendicular to the first and the second directions;

wherein the locator is formed with a connection portion supporter supporting the second connection portion; and wherein the contact supporters are separated from the connection portion supporter in the third direction.

2. The connector according to claim 1, wherein: each of the ground contacts has an end portion in the first direction; and the coupling portion couples only the end portions with the second connection portion.

3. The connector according to claim 1, wherein the second connection portion extends from the coupling portion in an orientation opposite to another orientation in which each of the ground contacts extends from the coupling portion.

4. The connector according to claim 1, further comprising a pair of signal contacts positioned between two of the ground contacts closest to each other in the second direction.

5. The connector according to claim 4, wherein each of the first cables comprises a pair of signal lines in addition to the drain line, respectively, the signal lines being configured to be connected to the signal contacts, the large-diameter line being larger in diameter than the signal line, wherein the locator is further provided with a plurality of locating hollows and a plurality of wall portions, the locating hollows locating and supporting the signal lines and the drain lines, respectively, the contact supporters arranging and supporting the signal contacts and the ground contacts, respectively, the wall portions and the contact supporters being alternatively arranged so that each of the wall portions separates neighboring signal contacts among the signal contacts or one of the ground contacts and the signal contact next to the ground contact.

6. A connector comprising:

a plurality of ground contacts, the ground contacts being provided with first connection portions, respectively, which are to be connected to drain lines of first cables, respectively;

a housing holding the ground contacts so that each of the ground contacts extends along a first direction;

a coupling portion formed integrally with the ground contacts, the coupling portion coupling the ground contacts so that the ground contacts are arranged in a second direction perpendicular to the first direction;

a second connection portion formed integrally with the coupling portion, the second connection portion being configured to be connected to a large-diameter line of a second cable different from the first cables, the second connection portion extending along the first direction and being larger than the first connection portion in the second direction; and a purpose-specified contact which is provided with a third connection portion, wherein:

the third connection portion is configured to be connected to a third cable, the third cable comprising a line which has a diameter same as the large-diameter line; and the second connection portion is separated from the third connection portion in the second direction.

7. The connector according to claim 6, comprising first and second contact rows, wherein:

the first contact row corresponds to the second row in a third direction perpendicular to the first direction and to the second direction;

the first contact row includes the ground contacts;

the second contact row includes the purpose-specified contact;

the purpose-specified contact is an outermost contact of the second contact row in the second direction; and the second connection portion is provided so that the second connection portion corresponds to a specific one of the ground contacts of the first contact row, the specific ground contact being positioned farther from the purposes-specified contact than remaining ones of the ground contacts of the first contact row in the second direction.

8. The connector according to claim 6, wherein: the third cable is a power supply cable; and the second cable is a power return cable.

* * * * *